US008808409B2

(12) United States Patent
Banner et al.

(10) Patent No.: US 8,808,409 B2
(45) Date of Patent: Aug. 19, 2014

(54) RECHARGEABLE FIRE STARTER AND LONG BURNING FUEL

(75) Inventors: Konel S. Banner, Riverdale, UT (US); Frank Weston, Riverdale, UT (US)

(73) Assignee: Insta-Fire LLC, Riverdale, UT (US)

( * ) Notice: Subject to any disclaimer, the term of this patent is extended or adjusted under 35 U.S.C. 154(b) by 317 days.

(21) Appl. No.: 12/366,366

(22) Filed: Feb. 27, 2009

(65) Prior Publication Data

US 2010/0218418 A1 Sep. 2, 2010

(51) Int. Cl.
*C10L 11/00* (2006.01)

(52) U.S. Cl.
USPC ..... 44/544; 44/540; 44/545

(58) Field of Classification Search
USPC ..... 44/544, 545, 540
See application file for complete search history.

(56) References Cited

U.S. PATENT DOCUMENTS

| | | | | | |
|---|---|---|---|---|---|
| 2,443,029 | A * | 6/1948 | Elkan | 44/565 |
| 3,089,760 | A * | 5/1963 | Jaffe | 502/400 |
| 3,338,691 | A * | 8/1967 | Knowles et al. | 44/275 |
| 3,540,865 | A * | 11/1970 | Pape | 431/326 |
| 3,846,086 | A * | 11/1974 | Balch | 44/280 |
| 6,093,224 | A * | 7/2000 | Jones | 44/502 |
| 2005/0169952 | A1 * | 8/2005 | Roddenbery et al. | 424/405 |

* cited by examiner

*Primary Examiner* — Cephia D Toomer
(74) *Attorney, Agent, or Firm* — Bateman IP

(57) ABSTRACT

A method and apparatus is disclosed for a rechargeable fire starter and a long burning fuel. The disclosure relates to a rechargeable fire starter and long burning fuel. The rechargeable fire starter and long burning fuel may comprise an absorbent having a porous mineral, or a combination of one or more porous minerals along with wood pellets. The absorbent may then be saturated with a flammable liquid. This combination provides a rechargeable fire starter and long burning fuel that is relatively impervious to moisture.

6 Claims, 5 Drawing Sheets

RECHARGEABLE FIRE STARTER AND LONG BURNING FUEL

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

1. The Field of the Disclosure

This disclosure relates generally to a rechargeable fire starter and long burning fuel. More particularly, this rechargeable fire starter and long burning fuel may comprise an absorbent including a porous mineral, or a combination of one or more porous minerals along with wood pellets, which absorbent may then be saturated with a flammable liquid. This combination provides a rechargeable fire starter and long burning fuel that is relatively impervious to moisture.

2. Description of Related Art

The use of an accelerant has long been known as a way of starting a fire when one is using hard to ignite materials. For example, charcoal is frequently ignited by pouring lighter fluid on the charcoal. The lighter fluid soaks into the charcoal. The lighter fluid is more flammable than the charcoal, and, when ignited, burns readily. The heat from the burning lighter fluid gradually ignites the charcoal. By the time the lighter fluid is consumed, the charcoal has been ignited and is burning on its own.

Other types of fire starters are also known, which generally comprise wood pellets or wood shavings mixed with wax. These are frequently pressed into a solid mass. The wax/wood combination is relatively easy to ignite and also relatively long burning. This type of fire starter can be used to ignite a wood stove or a campfire. It can also be used to ignite charcoal or coal.

An advantage of using fire starters is that they can be relatively impervious to moisture. Thus, they are very useful when trying to ignite wood or other fuel that is wet. As the fire starter burns, the heat from the fire starter dries the wet fuel so that it can be eventually be ignited by the fire starter and then burn on its own.

One disadvantage of fire starters of the liquid variety is that these fire starters can present a fire or explosion hazard if they leak from their containers. Fires starters of the wood/wax while not apt to leak, can generally be relatively bulky and difficult to use in certain applications.

SUMMARY

The current disclosure teaches and describes the use of an absorbent mineral saturated with a liquid accelerant, as a reusable fire starter and long burning fuel. The rechargeable fire starter and long burning fuel may comprise an absorbent having a porous mineral, or a combination of one or more porous minerals along with wood pellets. The absorbent may then be saturated with a flammable liquid. This combination provides a rechargeable fire starter and long burning fuel that is relatively impervious to moisture.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

At the outset, it should be appreciated that while the present disclosure is described with respect to what is presently considered to be exemplary embodiments, it is understood that the disclosure is not limited to the disclosed embodiments. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the disclosure, which is limited only by the appended claims.

Unless defined otherwise, all technical and scientific terms used herein have the same meaning as commonly understood to one of ordinary skill in the art to which this disclosure belongs. Although any methods, devices or materials similar or equivalent to those described herein can be used in the practice or testing of the disclosure, the preferred methods, devices, and materials are now described.

Figure 1:
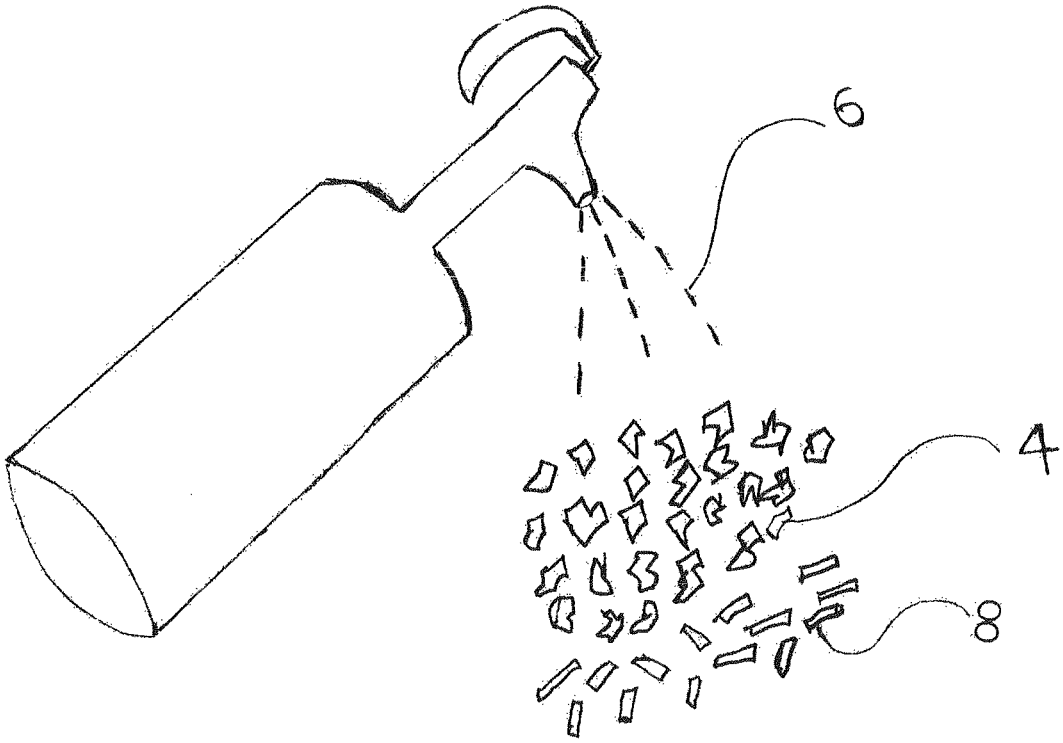
FIG. 1 is a perspective view of accelerant being applied to the absorbent.

As depicted in FIG. 1, an absorbent 4 may be comprised of one of the following porous minerals, or a combination of two or more of the following porous minerals: perlite, vermiculite, sodium silicate hydrate, calcium silicate hydrate, obsidian, pumice or any other porous mineral is saturated with a flammable liquid 6. Any porous mineral can be used as the absorbent. However, those minerals listed above are especially notable for their porosity and ability to absorb flammable liquid. For example, perlite and vermiculite can absorb up to five times their weight in flammable liquid. High absorbency is desirable because the more flammable liquid that the absorbent can absorb, the longer the fire starter will burn. One of the purposes of the long burning fire starter as disclosed herein is to produce a compact material that can burn for a long enough period of time to ignite a combustible fuel source such as wood, coal or charcoal. This time can range from 15 minutes to several hours, depending on how the product is prepared. Where the fire starter is to be used as a stand alone fuel source, the length of time that the fire starter will burn is also important because the longer that the fire starter will burn is directly related to the amount of fuel that is contained in the absorbent and hence, the amount of heat energy that is being contained in a given unit of fire starter.

The flammable liquid 6 may be comprised of one of the following, or a combination of two or more of the following: propylene glycol, mineral spirits, diesel fuel, kerosene, gasoline, methanol, liquid paraffin, or any other flammable liquid hydrocarbon.

This saturation may be accomplished by soaking the absorbent 4 in the flammable liquid 6, or by spraying the absorbent 4 with the flammable liquid 6 until the absorbent is saturated or nearly saturated or by any other means known in the art. While it may be desirable under certain circumstances to saturate the absorbent as fully as possible, complete saturation is not required to practice what is taught in this disclosure.

Figure 2:
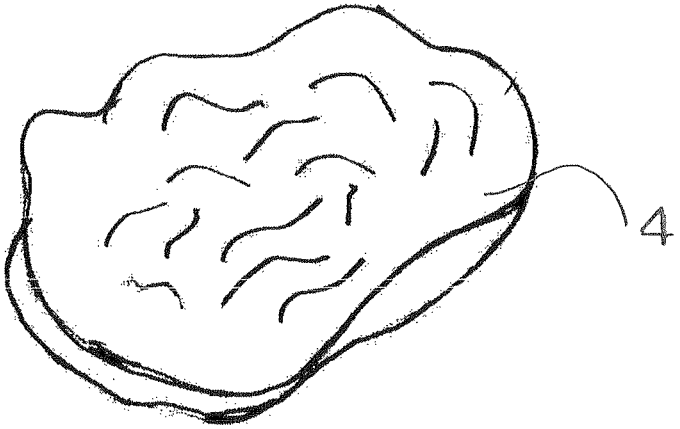
FIG. 2 is a cutaway view of a rotating drum in which the fire starter is rotated while being sprayed by a sealant.

The absorbent 4 may be in a solid form as depicted in FIG. 2. The absorbent 4 may also be crushed into particulate form as depicted in FIG. 1. In the embodiment depicted in FIG. 1, the absorbent 4 may be comprised of particulates of one quarter inch in diameter or less. The absorbent 4 may also be combined with wood particles 8 such as wood pellets, wood shavings, or saw dust. The combination of absorbent 4 and wood particles 8 is saturated with the flammable liquid 6. This may be accomplished by soaking the absorbent 4 and wood particles 8 or by spraying the absorbent 4 and wood particles 8 until the absorbent 4 and the wood particles 8 are saturated or nearly saturated or by any other means known in the art. It is also possible to substitute any combustible material for the wood particles. For example, coal or charcoal can be substituted for the wood particles or can be used along with wood particles. In the case of charcoal, its absorbent properties can be utilized as a way of holding flammable liquid, in addition to being a fuel source. Where the coal or charcoal is ground in particle size, it can be readily ignited by the flammable liquid and act as a bridge between the flammable liquid and the fuel that the user is actually seeking to ignite.

Figure 3:
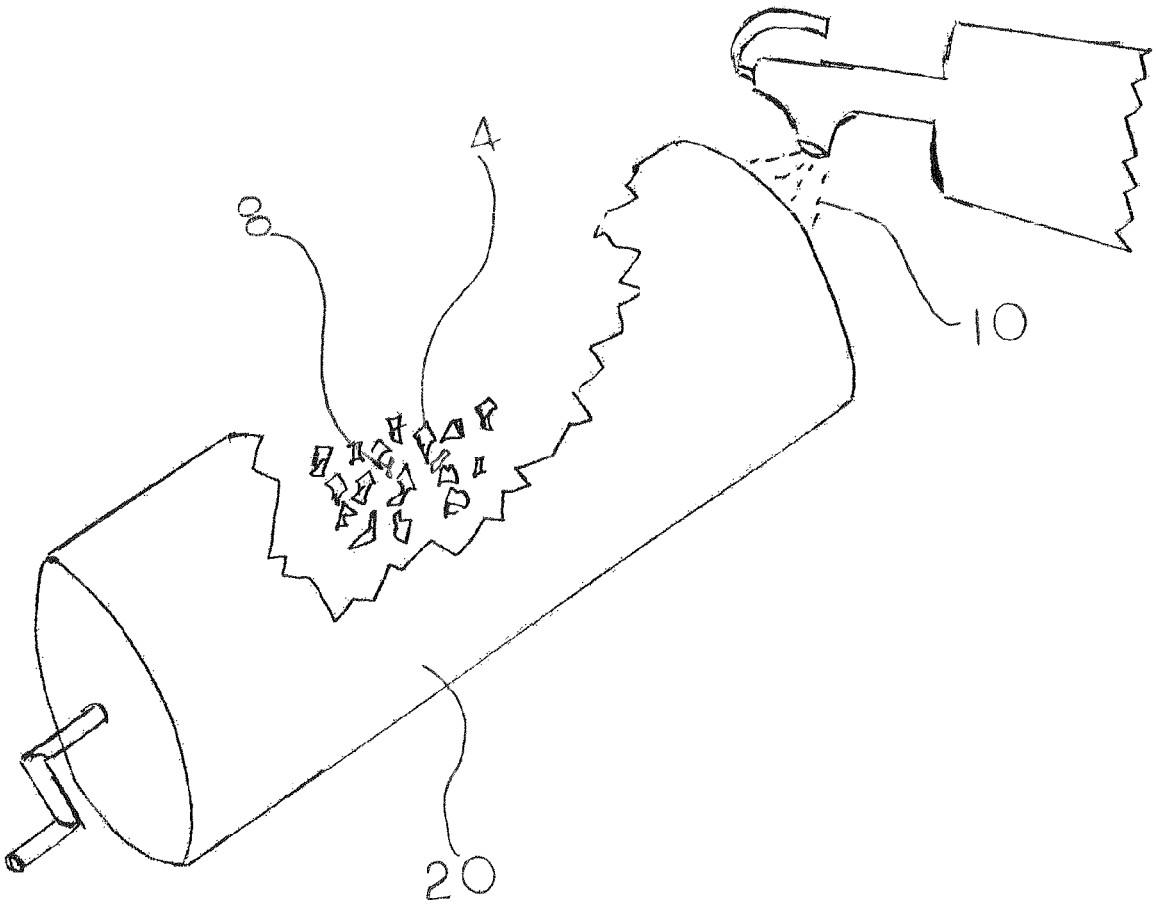
FIG. 3 is a side view of fire starter in a waterproof container.

Once the absorbent 4 or the combination of absorbent 4 and wood particles 8 has been saturated with flammable liquid 6, the absorbent 4 or the combination of absorbent 4 and wood particles 8 may be coated with a flammable sealant 10 such as molten paraffin wax. The sealant 10 may be applied to the individual absorbent 4 and wood particles 8, such that the absorbent 4 and wood particles 8 remain as individual particulates, separate and discrete from each other. One method to achieve this result is to tumble or agitate the saturated absorbent 4 and wood particles 8 as the sealant 10 is sprayed on the saturated absorbent 4 and wood particles 8 as depicted in FIG. 3. The tumbling or agitation process ensures that the saturated absorbent 4 and wood particles 8 will remain separated while being coated with the sealant 10. In the alternative, once the sealant 10 has been applied, the saturated absorbent 4 and wood particles 8 may be pressed together into one solid mass of any desired size and shape.

The sealant 10 makes the saturated absorbent 4 and wood particles 8 relatively impervious to moisture. Thus, even if the fire starter material is immersed in water, it can be readily ignited, as the sealant 10 will prevent water from reaching the absorbent or accelerant. Thus, the sealant 10 can be ignited first. The sealant 10 will then burn off, revealing the dry flammable liquid soaked absorbent 4, which will then ignite.

The saturated absorbent 4 and wood particles 8 can also be treated with a coloring agent so that the finished product will be of one uniform color such as red, blue, green, etc. In the alternative, the finished product can be treated with a combination of two or more coloring agents such that the finished product will be a combination of two or more colors. In addition, various fragrances can be added to the fire starter. In addition, various metal filings or flakes or metal alloy filings of flakes can be added to the fire starter to impart different colors to the flame. For example, if copper filings are added to the fire starter, the copper filings will impart a green hue to the flame.

Figure 4:
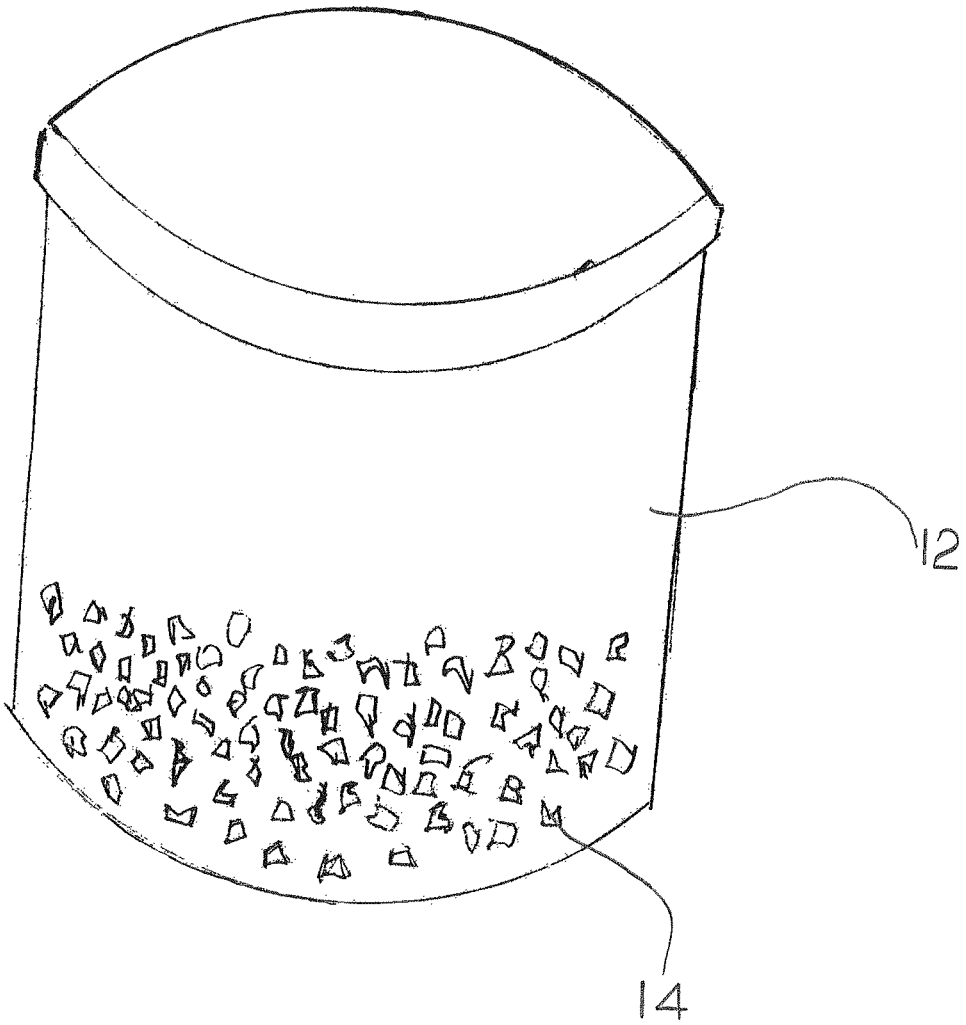
FIG. 4 is a side view of fire starter arranged under a pile of logs.

When finished, the fire starter 14 may be packaged in an air tight packaging material 12 as depicted in FIG. 4. Packaging the fire starter in an air tight packaging material 12 serves the purpose of keeping the fire starter 14 material together in one place. This is especially useful in the case of fire starter 14 that is in the form of discreet particles. Packaging the fire starter 14 in an air tight packaging material 12 serves the further purpose of preventing the flammable liquid 6 from evaporating from the absorbent 4.

Figure 5:
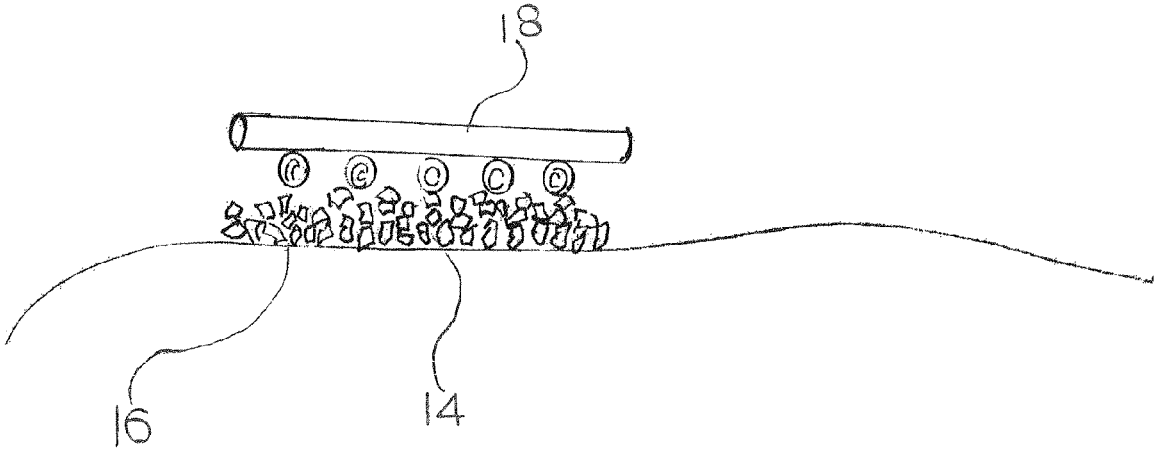
FIG. 5 is a side view of fire starter being used alone as a fuel.

To use the fire starter 14, a given amount of fire starter 14 is removed from the air tight packaging material 12 onto the ground or other surface sufficient to retain it. As depicted in FIG. 5, the fire starter 14 has been poured onto a flat surface 16 and wood 18 has been placed on top of it. When the fire starter 14 is ignited, the heat and flames will travel upward, through the wood 18, and gradually ignite the wood 18. Charcoal, or any other fuel can be substituted for the wood. Because of the insulating qualities of the absorbent 4 and sealant 10, the fire starter 14 can be poured directly onto snow or ice and ignited with very little tendency of the heat from the fire starter 14 to melt the snow or ice below.

Figure 6:
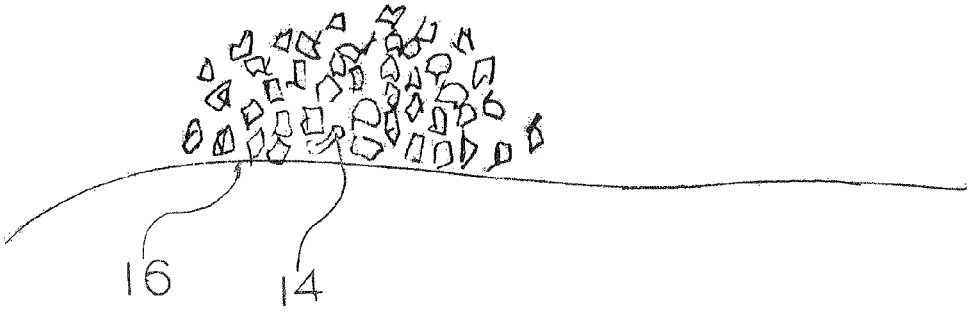
FIG. 6 is a side view of the fire starter on a flat surface.

In an alternative use, depicted in FIG. 6, the fire starter 14 alone is placed onto a flat surface 16 and ignited. In this application, the fire starter 14 is used as a stand alone fuel source and can be burned in a stove etc. as a heat source.

After the fire starter 14 has been used, the absorbent 4 can be resaturated with flammable liquid 6 and reused. In the alternative, the absorbent 4 can be both resaturated with flammable liquid 6 and coated with sealant 10 and be reused.

In the alternative, the fire starter can be packaged together with a combustible fuel such as wood, coal or charcoal to comprise a complete fire starter system. In such a system, the fire starter can be packaged in an air tight packaging with the fire starter and the combustible fuel packaged together into one transportable and compact unit. An advantage to a complete fire starter system is that it can be sold and transported as one unit to a campsite or carried as an emergency fuel in an automobile as a survival supply in the event of stranding, etc.

In the foregoing Detailed Description, various features of the disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description by this reference, with each claim standing on its own as a separate embodiment of the disclosure.

It is to be understood that the above-described arrangements are only illustrative of the application of the principles of the disclosure. Numerous modifications and alternative arrangements may be devised by those skilled in the art without departing from the spirit and scope of the disclosure and the appended claims are intended to cover such modifications and arrangements. Thus, while the disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A rechargeable fire starter comprising:

an absorbent comprised of a porous mineral;

wherein said absorbent is saturated with a flammable liquid;

wherein the absorbent is comprised of one or more of the following porous minerals: perlite, vermiculite, sodium silicate hydrate, pumice stone and obsidian; and wherein the flammable liquid comprises one or more of the following: ethanol, diesel fuel, kerosene, gasoline, methanol, liquid paraffin, or any other flammable liquid hydrocarbon, wherein the saturated absorbent is coated with a sealant and wherein the saturated absorbent is mixed with metal filings.

2. A method for making a rechargeable fire starter comprising:

beginning with an absorbent comprised of a porous mineral;

coating the absorbent with a liquid burning agent soaked into the absorbent;

wherein the absorbent is comprised of one or more of the following; perlite, vermiculite, sodium silicate hydrate, obsidian and charcoal in a particulate form;

wherein the liquid burning agent comprises one or more of the following: ethanol, diesel fuel, kerosene, gasoline, methanol, liquid paraffin, or any other flammable liquid hydrocarbon; and wherein the absorbent and the liquid burning agent is tumbled or agitated while being sprayed by a flammable sealant.

3. The method for making a rechargeable fire starter of claim 2, wherein the method further comprises adding wood particles to the absorbent to create the first starter.

4. The method for making the rechargeable fire starter of claim 2 comprising adding metal filing to the saturated absorbent.

5. The method for making the rechargeable fire starter of claim 2, wherein the flammable sealant comprises wax.

6. The method for making the rechargeable fire starter of claim 2, wherein the flammable sealant comprises paraffin wax.

* * * * *